US006592270B2

(12) United States Patent
Earle

(10) Patent No.: US 6,592,270 B2
(45) Date of Patent: Jul. 15, 2003

(54) DELIVERY SYSTEM

(75) Inventor: Anthony Earle, Harrow Weald (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/134,253

(22) Filed: Apr. 29, 2002

(65) Prior Publication Data

US 2003/0006249 A1 Jan. 9, 2003

(30) Foreign Application Priority Data

Jun. 7, 2001 (GB) ..... 0113857

(51) Int. Cl.[7] ..... G03D 3/02
(52) U.S. Cl. ..... 396/571; 137/563; 396/626
(58) Field of Search ..... 396/617–626, 396/571; 355/27–29, 40, 41, 77; 134/64 P, 64 R, 122 P, 122 R; 137/563

(56) References Cited

U.S. PATENT DOCUMENTS

| | | | |
|---|---|---|---|
| 4,421,399 A | 12/1983 | Steube | 396/626 |
| 4,958,666 A | 9/1990 | Kocourek et al. | 396/626 |

FOREIGN PATENT DOCUMENTS

| | | |
|---|---|---|
| DE | 37 32 949 A | 4/1989 |
| EP | 1 069 474 A1 | 1/2001 |

*Primary Examiner*—Della Rutledge
(74) *Attorney, Agent, or Firm*—Frank Pincelli

(57) ABSTRACT

A solution delivery system for a processor holds and delivers the processing solutions at working temperature. The solutions are held in an airtight chamber in which they are heated to the correct temperature. The solution is then transferred to a holding chamber until released into the processor.

20 Claims, 2 Drawing Sheets

DELIVERY SYSTEM

CROSS REFERENCE TO RELATED APPLICATIONS

This is a U.S. original patent application which claims priority on Great Britain patent application No. 0113857.7 filed Jun. 7, 2001.

FIELD OF THE INVENTION

This invention relates to the field of photographic film and paper processing machines, in particular to the chemical delivery systems for the machines.

BACKGROUND OF THE INVENTION

In existing photographic processing machines the chemicals have to be replenished in order to keep their chemical activity constant. If this is not done the photographic result will vary unacceptably due to the active chemicals being consumed by rendering the image visible and also by the action of oxidization over time with the oxygen in the atmosphere.

In some machines replenishment is achieved by using metering pumps which are accurately set to deliver cold replenisher solution directly into the hot working tank. The temperature effects are minimized by the large volume of solution in the process tank. The replenisher also raises the level in the tank and the surplus normally runs to waste over a weir arrangement. Depending on point of replenisher delivery it is possible to lose some fresh as well as used solution. When this arrangement is used the fresh chemicals are normally drawn directly by the metering pumps from tanks or delivery cans close to the point of use.

In larger machines it is normal to hold the replenisher in tanks (several 1000 liters) some distance from the point of use. In this instance gravity is frequently used to drive the solution down to set measuring glasses. The solution is admitted to the glass by an electrically operated valve on an instruction from the machine control system. An electrical level probe is set in the glass to switch off the solution supply when the pre-set amount is reached. A lower valve is then opened allowing the solution to flow down into the process machine tank. Volumetric measuring glasses are used in the Hostert leaderbelt machine. It is also known for accurate turbine flow meters and vortex shedding devices to be used in place of metering pumps and volumetric measuring glasses.

For example, a turbine flow meter is used in the San Marco TM "Flexileader" machine.

All of these delivery systems consisting of replenisher solution tanks, working process tanks and waste tanks are designed to keep chemistry at constant activity levels over long periods. It also assumes the machine is used four or five times a day with a range of average subjects. As the subjects vary and the fresh chemistry is added in fixed predetermined volumes long-term activity drifts occur. To prevent this process check exposures are normally passed through the process and depending on the results the tank is either spiked with extra replenisher or diluted.

The above methods are unsuitable for small machines used intermittently without supervision or for machines where the chemistry is used once and then discarded.

SUMMARY OF THE INVENTION

This invention aims to overcome all of the above limitations particularly when applied to walk up machines which do not have process tanks holding solutions, which are used intermittently without supervision and where just sufficient volumes of fresh chemistry is dispensed, on demand, for one process cycle.

This invention is a system for holding and delivering at working temperature volumes of liquids into any type of photographic or other processor quickly by the use of a "dump" valve. It is specially designed to minimize wetting effects and improve uniformity in single use chemical process cycles or processes with short process cycles of less than 25 seconds. The invention can also be used in combined single use and short time process cycles.

According to the present invention there is provided a delivery system for a processor comprising means for supplying solution to an airtight chamber, heating means for heating the solution within the chamber, means for transferring a predetermined volume of heated solution from the airtight chamber to a holding chamber and means for releasing the heated solution from the holding chamber such that the solution drops into the processor. Preferably the airtight chamber has a plurality of solution chambers which may hold different solutions. The solution chambers may also vary in volume if desired.

The invention further provides a method of supplying processing solution to a processor comprising the steps of supplying solution to an airtight chamber, heating the solution within the airtight chamber, transferring a predetermined volume of heated solution from the airtight chamber to a holding chamber and dropping the heated solution from the holding chamber into the processor.

The invention provides numerous advantages.

It is easy to change the volumes of solution by changing the number of complete cycles made by the pump. Due to the sealed system the chemistry is kept at the required temperature which substantially eliminates oxidation. The chemicals are also delivered at the correct temperature. There is no warm up or waiting time. The chemicals are delivered quickly which improves uniformity in single use systems. There is less heat loss from the small airtight chambers.

All solutions are handled by one valve which is self cleaning. Solution drain back is prevented by using simple non-return valves in the valve assembly. This ensures accurate delivery from the first pump stroke. The holding cartridge is able to accommodate all of the different volumes used in the process. The holding cartridge can be designed with a plurality of solution chambers. The solutions can be a different temperature to the process vessel enabling the process to be either "kick started" or "soft started" according to the particular process requirements.

BRIEF DESCRIPTION OF THE DRAWINGS

The invention will now be described, by way of example, with reference to the accompanying drawings, in which.

DETAILED DESCRIPTION OF THE INVENTION

Figure 1:
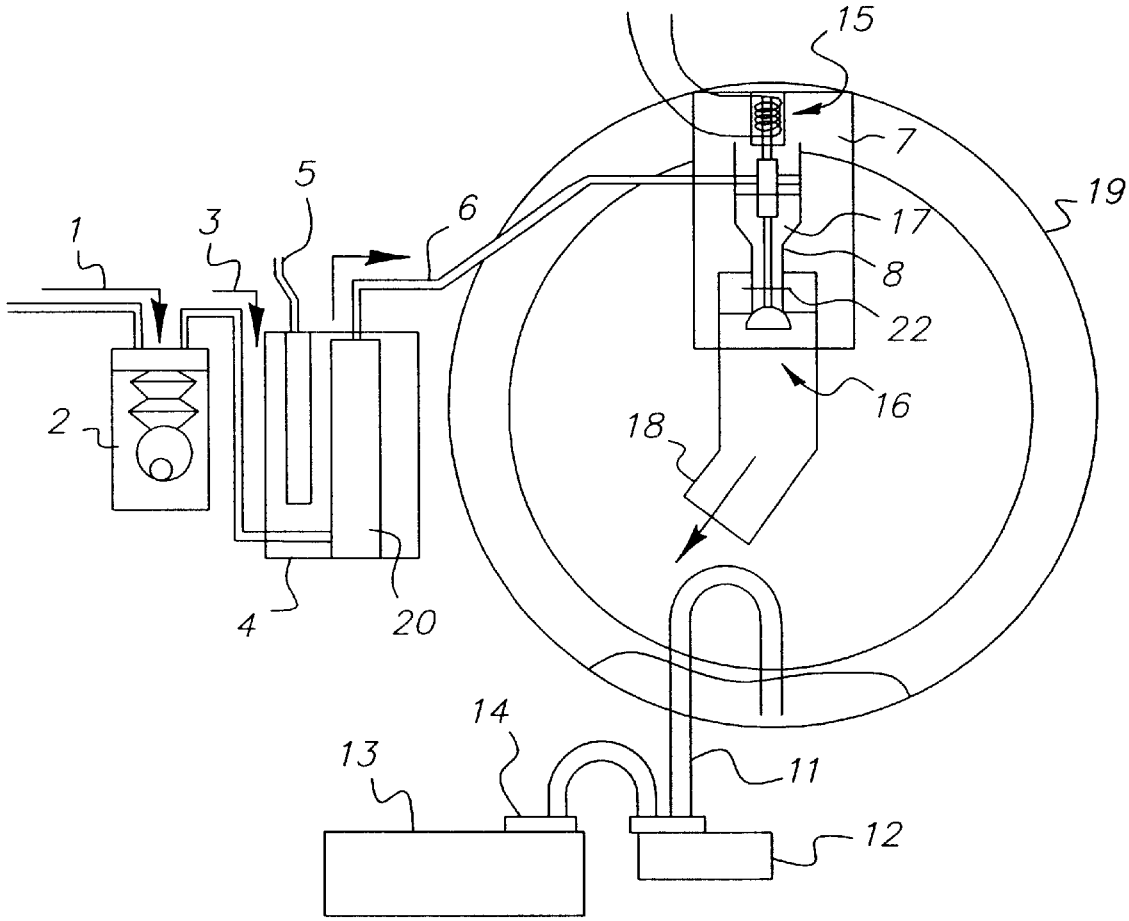
FIG. 1 shows a delivery system according to the invention.

FIG. 1 shows the basic arrangement of a delivery system according to the invention.

A valve assembly 8 is arranged inside a processing enclosure 19. In the embodiment illustrated the valve assembly is attached to the roof of the enclosure. However, the assembly may be arranged anywhere suitable. The photographic process chamber takes the form of a rotatable drum. Such a processor is fully described in GB 0023091.2, the contents of which are herein incorporated by reference. This processor is by way of example only and the invention is not limited to such a processor.

A drain pipe 11 is located at the lower part of the process chamber. The drain pipe 11 is connected to the suction side of a pump 12. The output side of the pump 12 is connected to a waste container 13 via pipe 14.

The valve assembly 8 within the processing enclosure 19 is provided with a solution holding chamber 7 and a delivery pipe 18. The solution holding chamber 7 is of such a size that when the correct volume of processing solution required for the process is contained therein the level of the solution is below the level at which the solution enters. This has the advantage that cross contamination is reduced. In the embodiment shown the valve is actuated by a solenoid 15. However, any suitable actuating means may be used. The solenoid 15 is in connection with a connection assembly 17 which is in turn connected to a sealing member 16. The sealing member 16 is self aligning, the solenoid 15 having sufficient freedom of movement to accommodate this. The sealing member 16 may be made of any material compliant enough to form a good seal. Suitable materials may be nitrile rubber, silicon rubber or EPDM. In the embodiment illustrated the sealing member has a hemispherical shape. However this particular shape is not essential to the invention. The sealing member 16 seals the delivery area 22 of the solution holding chamber 7 until the solution is required in the processing chamber.

The valve assembly 8 is supplied from a sealed airtight chamber, hereinafter referred to as a holding cartridge 4. Valve assembly 8 and holding cartridge 4 are connected via pipe 6. The pipe 6 may contain a non return valve. Alternatively, a non return valve may be provided at either end of the pipe, as long as run back of the solution from the valve assembly is precluded. The "non return valve" may take the form of a slit in the pipe 6.

The holding cartridge 4 has at least one solution chamber 20 and a heater 5. The volume of the solution chamber 20 is greater than that of the solution required for one process. The holding cartridge is connected to a supply of processing solution, not shown, via supply pipe 1, pump 2 and delivery pipe 3. The delivery pipe 3 is connected to the bottom of the holding cartridge 4. Each required solution, for example, developer, fixer and wash water, would have a supply pipe, pump and delivery pipe connected to the respective solution chamber. Each solution chamber has its own pipe 6 for delivery to the holding chamber 7. The developer would issue from the lowest pipe in the holding chamber. Fixer would issue from the pipe above and wash water would issue from the highest pipe to wash the whole system before being dropped into the process chamber to wash the photographic material. For simplicity only one pipe is shown in the drawings.

It is possible for there to be more than one holding cartridge 4. This would be beneficial should solutions be required at different temperatures. In such an embodiment each holding cartridge 4 would have at least one solution chamber and heater as described above. Each holding cartridge 4 would have a respective supply pipe, pump and delivery pipe.

The delivery system works as follows.

A signal is sent to the pump 2. This could for example be a signal that the film is correctly loaded within the processing chamber. When the pump 2 is operated the delivery pipe 3 delivers a predetermined amount of solution to the bottom of heated holding cartridge 4, into the solution chamber 20. The amount of solution is determined by the pump setting. More than one cycle of the pump may be required to deliver the volume of solution required by the process. The volume of solution held in the chamber of the holding cartridge 4 is two or three times more than is required for one process. This ensures that there is always heated solution ready to go on demand. As the system is airtight solutions can be held at temperature for long periods without evaporation or degradation by the action of aerial oxidization.

The solution in the cartridge is heated to the required temperature. For example for a C 41 process the solution is heated to 35° C. The cartridge 4 can have its own heater 5 and control, as illustrated, to aid initial heat up. Alternatively the cartridge could be mounted in the body of the machine which could be heated. As stated above the cartridge 4 can have more than one solution chamber 20.

As the predetermined volume of cold solution is pumped into the bottom of the chamber 20 an equal volume of hot solution is displaced from the top and travels along pipe 6. As the pressure of the solution is positive due to the pump 2 it opens a non-return valve, not shown, and flows into the holding chamber 7 in the dump valve assembly 8.

The hot solution from heated holding cartridge 4 is held in the valve assembly 8 until required. The solution is held in the valve assembly by applying a voltage to the solenoid 15. This pulls up the self centering sealing member 16.

To drop the solution into the processing chamber the voltage supply to the solenoid 15 is switched off. This allows the sealing member 16 to fall, breaking the seal and allowing the solution to flow out of the valve assembly 8 via the delivery pipe 18.

The valve assembly 8 in this embodiment is mounted so that it will drop the solution into the processing chamber 19 as indicated by the arrow 9. At the end of each process step the chamber 19 is emptied of solution by suction of the pump 12 via drain pipe 11. The output from pump 12 is delivered to the waste container 13 by the connecting pipe 14.

It will be noticed that the cross sectional area of the delivery pipe 18 is larger than the delivery area 22 of the holding chamber 7. This is so that the solution is 'dumped' as fast as possible in one go, there being no restrictions to the flow of solution out of the holding chamber. This is necessary to establish an even wetting front with no drips or splashes in the processing chamber. The amount of solution can be very closely controlled by this system.

Figure 2:
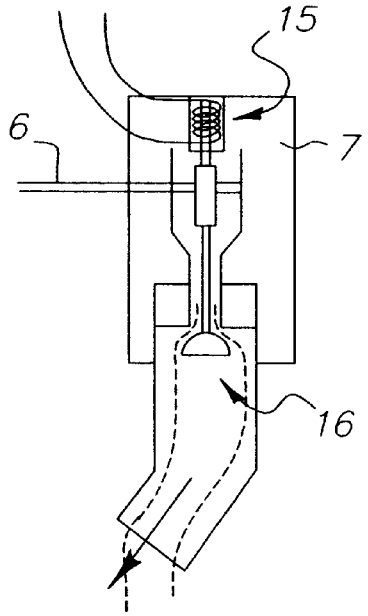
FIG. 2 shows a valve assembly used in the system.

FIG. 2 shows the valve assembly 8 in the open position when the power is switched off to dump the solution. It will be seen that the whole assembly including the sealing member 16 has moved down, breaking the seal and allowing the solution to flow into the processing chamber.

The valve assembly 8 is only closed when solution is being held in the holding chamber 7 prior to be dropped into the processing chamber. Thus the voltage supply is only switched on when required to hold this solution. The system is therefore energy efficient. The system also reduces the possibility of chemicals drying and sticking the valve assembly shut, thus preventing it working.

Figure 3:
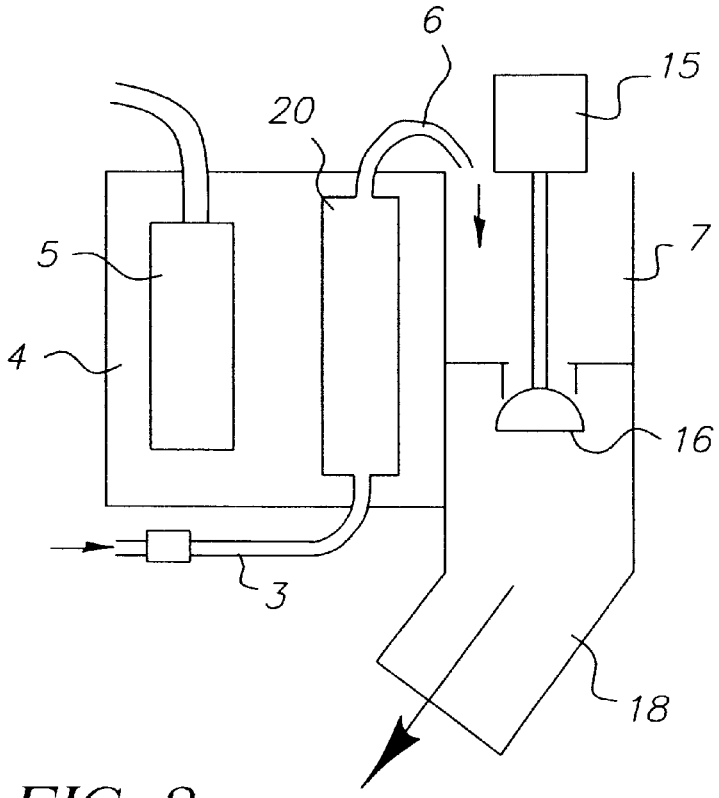
FIG. 3 shows a further embodiment of the delivery system.

FIG. 3 shows a further embodiment of the delivery system. In this embodiment the valve assembly 8 and the sealed holding cartridge 4 are formed in one unit.

The invention has been described in detail with reference to preferred embodiments thereof. It will be understood by those skilled in the art that variations and modifications can be effected within the scope of the invention.

| PARTS LIST |
|---|
| 1. supply pipe |
| 2. pump |
| 3. delivery pipe |
| 4. holding cartridge |
| 5. heater |
| 6. pipe |
| 7. holding chamber |
| 8. valve assembly |
| 11. pipe |
| 12. pump |
| 13. waste container |
| 14. pipe |
| 15. solenoid |
| 16. sealing member |
| 17, connection assembly |
| 18. delivery pipe |
| 19. processing enclosure |
| 20. solution chamber |
| 22. delivery area |

What is claimed is:

1. A delivery system for a processor comprising means for supplying solution to an airtight chamber, heating means for heating the solution within the chamber, means for transferring a predetermined volume of heated solution from the airtight chamber to a holding chamber and means for releasing the heated solution from the holding chamber such that the solution drops into the processor.

2. A delivery system as claimed in claim 1 wherein the airtight chamber has a plurality of solution chambers.

3. A delivery system as claimed in claim 2 wherein the plurality of solution chambers hold different solutions, the solutions being sequentially transferred to the processor.

4. A delivery system as claimed in claim 2 wherein the solution chambers vary in volume.

5. A delivery system as claimed in claim 1 wherein a plurality of airtight chambers are provided, each airtight chamber being provided with respective supply means, heating means and means for transferring a predetermined volume of heated solution from the airtight chamber to a holding chamber.

6. A delivery system as claimed in claim 1 wherein the means for transferring the solution from the airtight chamber to the holding chamber comprises a pipe.

7. A delivery system as claimed in claim 1 wherein the means for transferring the solution from the airtight chamber to the holding chamber includes a non return valve.

8. A delivery system as claimed in claim 1 wherein the holding chamber is part of a valve assembly, the assembly further including a delivery pipe, a sealing member for sealing a delivery area of the holding chamber from the delivery pipe and means for moving the sealing member to open the delivery area between the holding chamber and the delivery pipe to enable the solution to drop through the delivery pipe into the processor.

9. A delivery system as claimed in claim 8 wherein the delivery pipe has a larger cross-sectional area than the delivery area of the holding chamber.

10. A delivery system as claimed in claim 8 wherein the sealing member is moved by means of a solenoid.

11. A delivery system as claimed in claim 8 wherein the sealing member has a hemispherical shape.

12. A delivery system as claimed in claim 8 wherein the sealing member is made of a compliant material.

13. A delivery system as claimed in claim 8 wherein the valve assembly and the airtight chamber are formed as one unit.

14. A method of supplying processing solution to a processor comprising the steps of supplying solution to an airtight chamber, heating the solution within the airtight chamber, transferring a predetermined volume of heated solution from the airtight chamber to a holding chamber and dropping the heated solution from the holding chamber into the processor.

15. A method as claimed in claim 14 wherein the solution is transferred from the airtight chamber to the holding chamber via a pipe and a non-return valve.

16. A method as claimed in claim 14 wherein the solution is pumped into the airtight chamber.

17. A valve assembly for use in a delivery system for a processor, the valve assembly comprising a holding chamber, a delivery pipe, a sealing member for sealing a delivery area of the holding chamber from the delivery pipe and means for moving the sealing member to open the delivery area between the holding chamber and the delivery pipe, the delivery pipe having a larger cross-sectional area than the delivery area of the holding chamber.

18. A valve assembly as claimed in claim 17 wherein the sealing member is moved by means of a solenoid.

19. A valve assembly as claimed in claim 17 wherein the sealing member has a hemispherical shape.

20. A valve assembly as claimed in claim 17 wherein the sealing member is made of a compliant material.

* * * * *